US007052378B2

(12) United States Patent
Tateiwa et al.

(10) Patent No.: US 7,052,378 B2
(45) Date of Patent: May 30, 2006

(54) LIQUID JET MACHINING APPARATUS

(75) Inventors: Satoshi Tateiwa, Tokyo (JP); Ken Kimura, Tokyo (JP); Takayuki Umahashi, Tokyo (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 11/071,109

(22) Filed: Mar. 4, 2005

(65) Prior Publication Data

US 2005/0202764 A1 Sep. 15, 2005

(30) Foreign Application Priority Data

Mar. 9, 2004 (JP) ..... 2004-065600
Mar. 9, 2004 (JP) ..... 2004-065602

(51) Int. Cl.
*B24B 55/12* (2006.01)

(52) U.S. Cl. ..... 451/87; 451/453; 83/177

(58) Field of Classification Search ..... 451/75, 451/87, 442, 453, 457, 39, 40; 83/53, 177
See application file for complete search history.

(56) References Cited

U.S. PATENT DOCUMENTS 4,872,293 A * 10/1989 Yasukawa et al. ..... 451/75
4,920,841 A * 5/1990 Johnson ..... 83/177
4,964,244 A * 10/1990 Ehlbeck ..... 451/453
5,295,425 A * 3/1994 Hediger ..... 83/177
5,980,372 A * 11/1999 Spishak ..... 451/453
6,672,948 B1 * 1/2004 Mizuno ..... 451/60

FOREIGN PATENT DOCUMENTS

| | | |
|---|---|---|
| JP | 64-3626 | 1/1989 |
| JP | 4-256600 | 9/1992 |
| JP | 10-249800 | 9/1998 |
| JP | 2-232199 | 9/1999 |

* cited by examiner

*Primary Examiner*—Jacob K. Ackun, Jr.
(74) *Attorney, Agent, or Firm*—Smith, Gambrell & Russell, LLP

(57) ABSTRACT

A liquid jet machining apparatus including holding means for holding a workpiece, liquid jet application means for applying a liquid jet to the workpiece held by the holding means, and catching means for catching the liquid jet which has penetrated the workpiece. The catching means includes a tank for accommodating a liquid. At the bottom of the tank, a cushioning member is replaceably disposed, and an abrasive is accumulated. The liquid jet having penetrated the workpiece acts on the liquid accommodated in the tank, and then acts on the cushioning member and the abrasive. Wave suppressing means for suppressing generation of waves due to the liquid jet acting on the liquid accommodated within the tank is disposed in an upper portion of the tank.

9 Claims, 4 Drawing Sheets

LIQUID JET MACHINING APPARATUS

FIELD OF THE INVENTION

This invention relates to a liquid jet machining apparatus for applying a liquid jet to a workpiece. More specifically, the invention relates to a liquid jet machining apparatus of a type in which catching means for catching a liquid jet having penetrated a workpiece includes a tank for accommodating a liquid.

DESCRIPTION OF THE PRIOR ART

As disclosed in Japanese Patent Publication No. 1989-3626, Japanese Patent Application Laid-Open No. 1990-232199, Japanese Patent Application Laid-Open No. 1992-256600, and Japanese Patent Application Laid-Open No. 1998-249800, liquid jet machining apparatuses for applying a liquid jet to a workpiece are used for precision machining of a workpiece, such as cutting of a semiconductor substrate. Such a liquid jet machining apparatus includes a holding means for holding a workpiece, a liquid jet application means for applying a liquid jet, such as a water jet, to the workpiece held by the holding means, and a catching means for catching the liquid jet which has penetrated the workpiece. An abrasive can be incorporated into the liquid jet. The catching means includes a tank for accommodating a liquid which may be water. A cushioning member is replaceably disposed at the bottom of the tank. The liquid jet, which has penetrated the workpiece, moves into the tank and acts on the liquid within the tank, thus having its kinetic energy decreased. Further, the liquid jet acts on the cushioning member, thus having its kinetic energy decreased further. When the cushioning member is excessively damaged by the repeated action of the liquid jet, the damaged cushioning member is replaced by a new cushioning member.

However, a conventional liquid jet machining apparatus of a type in which catching means is composed of a tank for accommodating a liquid poses the following problems to be solved: First, the liquid jet having penetrated the workpiece acts on the liquid within the tank, and then acts on the cushioning member. Then, the liquid jet is reflected by the cushioning member to act on the wall of the tank. If a high speed liquid jet having a velocity of the order of 2 to 3 times the sound velocity is used, in particular, the liquid jet has a considerable kinetic energy remaining even after acting on the liquid inside the tank, and then acting on the cushioning member. Thus, not only the cushioning member, but the tank itself may also be damaged in a relatively short period.

Secondly, when the liquid jet moves into the liquid accommodated in the tank, huge waves are generated on the surface of the liquid and, because of the waves, the liquid tends to splash out of the tank into the surroundings.

SUMMARY OF THE INVENTION

It is a first object of the present invention, therefore, to provide a novel and improved liquid jet machining apparatus in which damage to a tank in a catching means is sufficiently suppressed or prevented.

It is a second object of the present invention to provide a novel and improved liquid jet machining apparatus which sufficiently suppresses or prevents the generation of huge waves on the surface of a liquid accommodated in the tank of the catching means, thereby sufficiently suppressing or preventing the splashing of the liquid out of the tank into the surroundings.

According to a first aspect of the present invention, to attain the first object, a cushioning member is replaceably disposed, and an abrasive is accumulated, at the bottom of a tank; after a liquid jet having penetrated a workpiece acts on a liquid accommodated in the tank, the liquid jet is caused to act on the cushioning member and the abrasive.

That is, according to the first aspect of the present invention, there is provided, as a liquid jet machining apparatus for attaining the first object, a liquid jet machining apparatus including a holding means for holding a workpiece, a liquid jet application means for applying a liquid jet to the workpiece held by the holding means, and a catching means for catching the liquid jet which has penetrated the workpiece, the catching means including a tank for accommodating a liquid, and wherein at the bottom of the tank, a cushioning member is replaceably disposed, and an abrasive is accumulated; and after the liquid jet having penetrated the workpiece acts on the liquid accommodated in the tank, the liquid jet acts on the cushioning member and the abrasive.

Preferably, the liquid jet advances into the tank substantially vertically downwardly, the tank is erected, the bottom wall of the tank has a first inclined portion inclined downwardly toward one side in a width direction, and a second inclined portion inclined upwardly toward the one side in the width direction in succession to the first inclined portion, and the cushioning member extends along the first inclined portion. Preferably, the cushioning member is inclined at an inclination angle of 40 to 50 degrees. It is preferred that the length in the inclination direction of the first inclined portion is larger than the length in the inclination direction of the second inclined portion; the site of the cushioning member acted on by the liquid jet is located at a higher position than the upper end of the second inclined portion; and in a rest state where the liquid jet is not applied to the workpiece, the upper surface of the abrasive accumulated in the tank is preferably above that site of the cushioning member. Preferably, the abrasive is incorporated in the liquid jet, and the abrasive within the tank is recovered from the tank and supplied to the liquid jet application means. Advantageously, an abrasive suction pipe having many suction holes formed in its pipe wall is disposed within the tank and, in a rest state where the liquid jet is not applied to the workpiece, the abrasive suction pipe is disposed above the upper surface of the abrasive accumulated within the tank.

According to a second aspect of the present invention, to attain the second object, a wave suppressing means for suppressing generation of waves due to the liquid jet acting on the liquid accommodated within the tank is disposed in an upper portion of the tank.

That is, according to the second aspect of the present invention, there is provided, as a liquid jet machining apparatus for attaining the second object, a liquid jet machining apparatus including a holding means for holding a workpiece, a liquid jet application means for applying a liquid jet to the workpiece held by the holding means, and a catching means for catching the liquid jet which has penetrated the workpiece, the catching means including a tank for accommodating a liquid, and wherein a wave suppressing means for suppressing generation of waves due to the liquid jet acting on the liquid accommodated within the tank is disposed in an upper portion of the tank.

In preferred embodiments, the liquid jet advances into the tank substantially vertically downwardly; the tank is erected; the wave suppressing means includes a tubular wave restricting member for surrounding the site of the upper surface of the liquid accommodated within the tank, the site being acted on by the liquid jet, and an elastic wave cushioning member filled into the tubular wave restricting member; in a rest state where the liquid jet is not applied to the workpiece, the tubular wave restricting member extends continuously from above the upper surface of the liquid accommodated within the tank into the liquid; the wave cushioning member is located above the upper surface of the liquid accommodated within the tank; and a through-hole, through which the liquid jet is passed, is formed in the wave cushioning member. The wave suppressing means preferably further includes an annular wave restricting member which protrudes horizontally inwardly from the inner surface of the wall of the tank, surrounds the tubular wave restricting member at a spacing from the outer peripheral surface of the tubular wave restricting member and, in a rest state where the liquid jet is not applied to the workpiece, is located above the upper surface of the liquid accommodated in the tank. It is preferred that a partition wall is disposed in the tank; the interior of the tank is divided into a main portion and an additional portion which communicate with each other only in a lower portion of the tank; the wave suppressing means is disposed in the main portion; and a liquid upper surface detecting means for detecting the upper surface of the liquid accommodated in the tank is disposed in the additional portion.

DETAILED DESCRIPTION OF THE PREFERRED EMBODIMENTS

Figure 1:
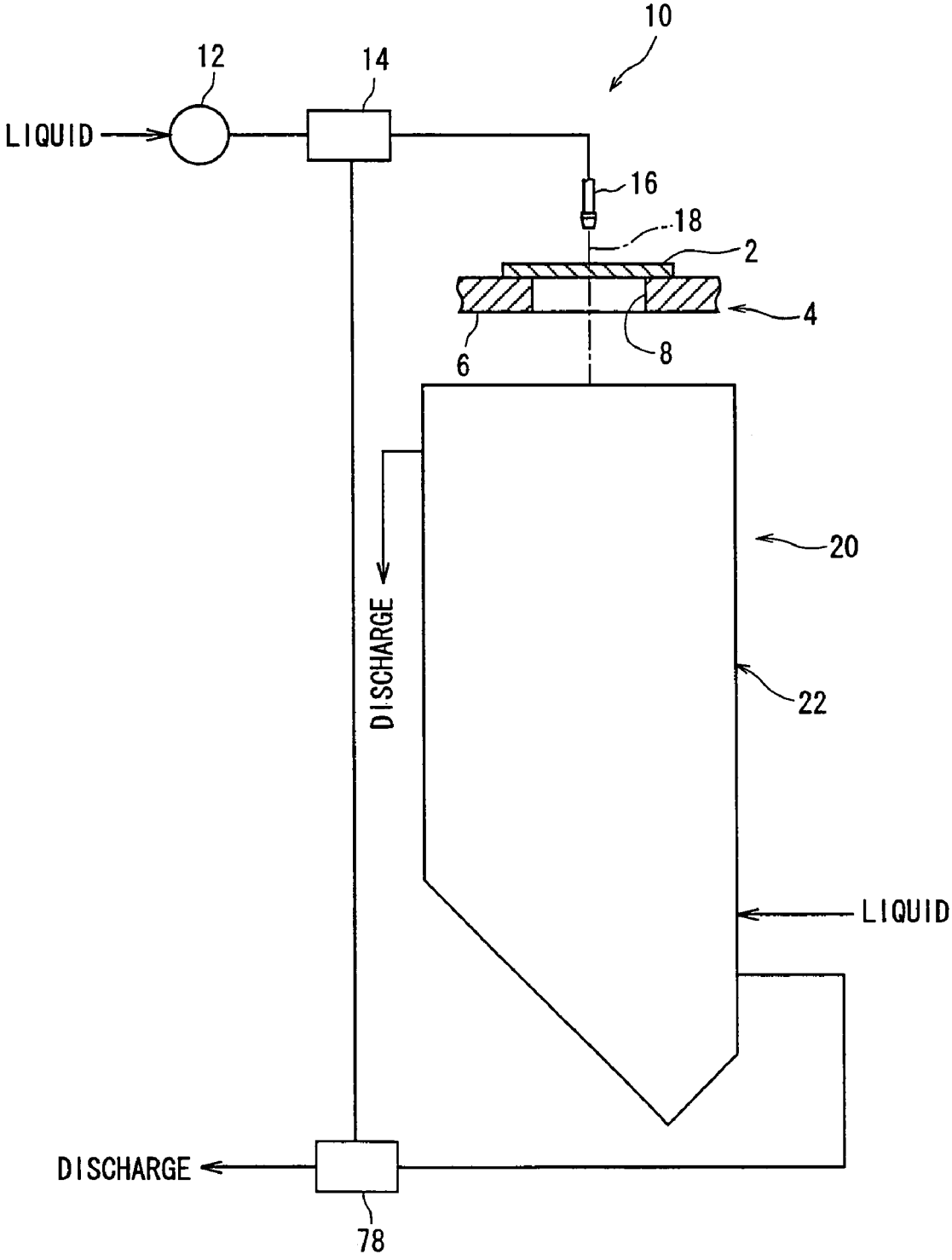
FIG. 1 is a schematic view showing a preferred embodiment of a liquid jet machining apparatus constructed in accordance with the present invention.

FIG. 1 schematically shows a preferred embodiment of a liquid jet machining apparatus constructed in accordance with the present invention. The liquid jet machining apparatus includes a holding means 4 for holding a workpiece 2 such as a semiconductor substrate. The illustrated holding means 4 is composed of a holding plate 6 extending substantially horizontally, and an opening 8 as a through-hole which may be rectangular or circular is formed in the holding plate 6. The holding plate 6 is mounted so as to be movable in a right-and-left direction and a direction perpendicular to the sheet face in FIG. 1. The holding plate 6 is moved by a suitable drive means (not shown) in the right-and-left direction and the direction perpendicular to the sheet face. The workpiece 2 is fixed on the holding plate 6 by a suitable fixing means (not shown), such as a clamping means or a vacuum attraction means, with a site of the workpiece 2 to be machined or cut being located on the opening 8.

A liquid jet application means, indicated entirely at a reference numeral 10, is disposed in the liquid jet machining apparatus. The liquid jet application means 10 includes a liquid pressurizing means 12, an abrasive incorporating means 14, and a nozzle means 16. The nozzle means 16 is disposed above the holding means 4. The liquid pressurizing means 12, which can be composed of a high pressure pump, is supplied with a liquid which may be tap water or pure water. The liquid pressurizing means 12 pressurizes the supplied liquid to convert it into a high pressure liquid, for example, of the order of 600 to 700 bars, and supplies such a high pressure liquid to the abrasive incorporating means 14. In the abrasive incorporating means 14, an abrasive is incorporated into the high pressure liquid. The abrasive may be garnet particles, diamond particles, or alumina particles having a particle size of the order of several tens of micrometers. The high pressure liquid incorporating the abrasive is supplied to the nozzle means 16, and the nozzle means 16 releases a liquid jet 18 (in FIG. 1, this liquid jet is indicated by a dashed dotted line) toward the workpiece 2 held by the holding means 4. The velocity of the liquid jet 18 is advantageously 2 to 3 times the sound velocity.

The catching means 20 is disposed below the holding means 4. As will be described in further detail later, the catching means 20 includes a tank 22 open at the upper surface, and a liquid which may be tap water or pure water is accommodated in the tank 22. The liquid jet 18 released from the nozzle means 16 penetrates the workpiece 2, passes through the opening 8 of the holding plate 6, and advances into the tank 22 of the catching means 20. When the holding means 4 is suitably moved while the nozzle means 16 is releasing the liquid jet 18, the workpiece 2 is cut along the path of movement of the holding means 4.

None of the holding means 4 and the liquid jet application means 10 in the illustrated liquid jet machining apparatus constitute novel features of the liquid jet machining apparatus constructed in accordance with the present invention. They may themselves be of well known forms, and thus their detailed descriptions will be omitted herein.

Figure 2:
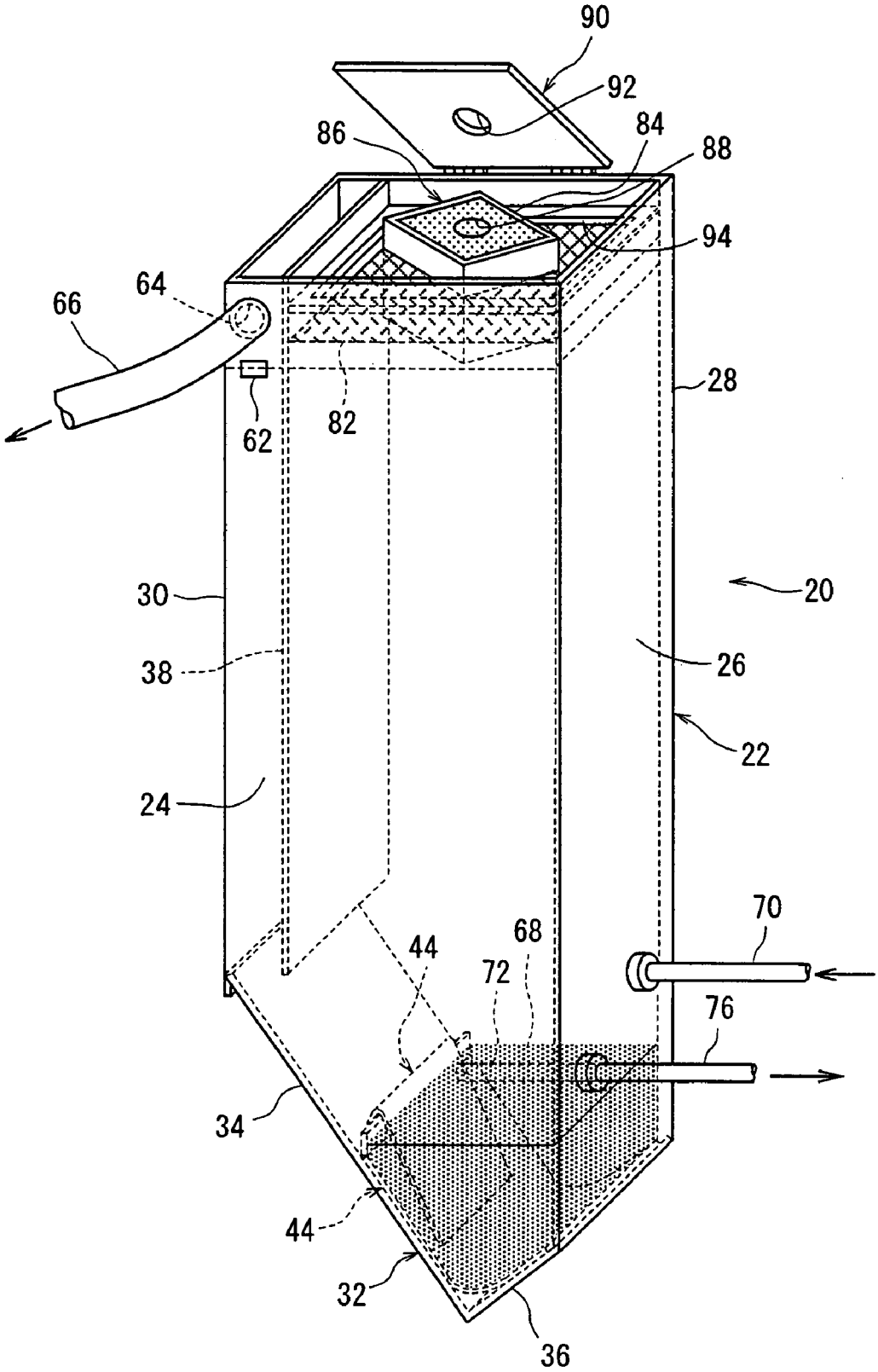
FIG. 2 is a perspective view showing a catching means in the liquid jet machining apparatus of FIG. 1.
Figure 3:
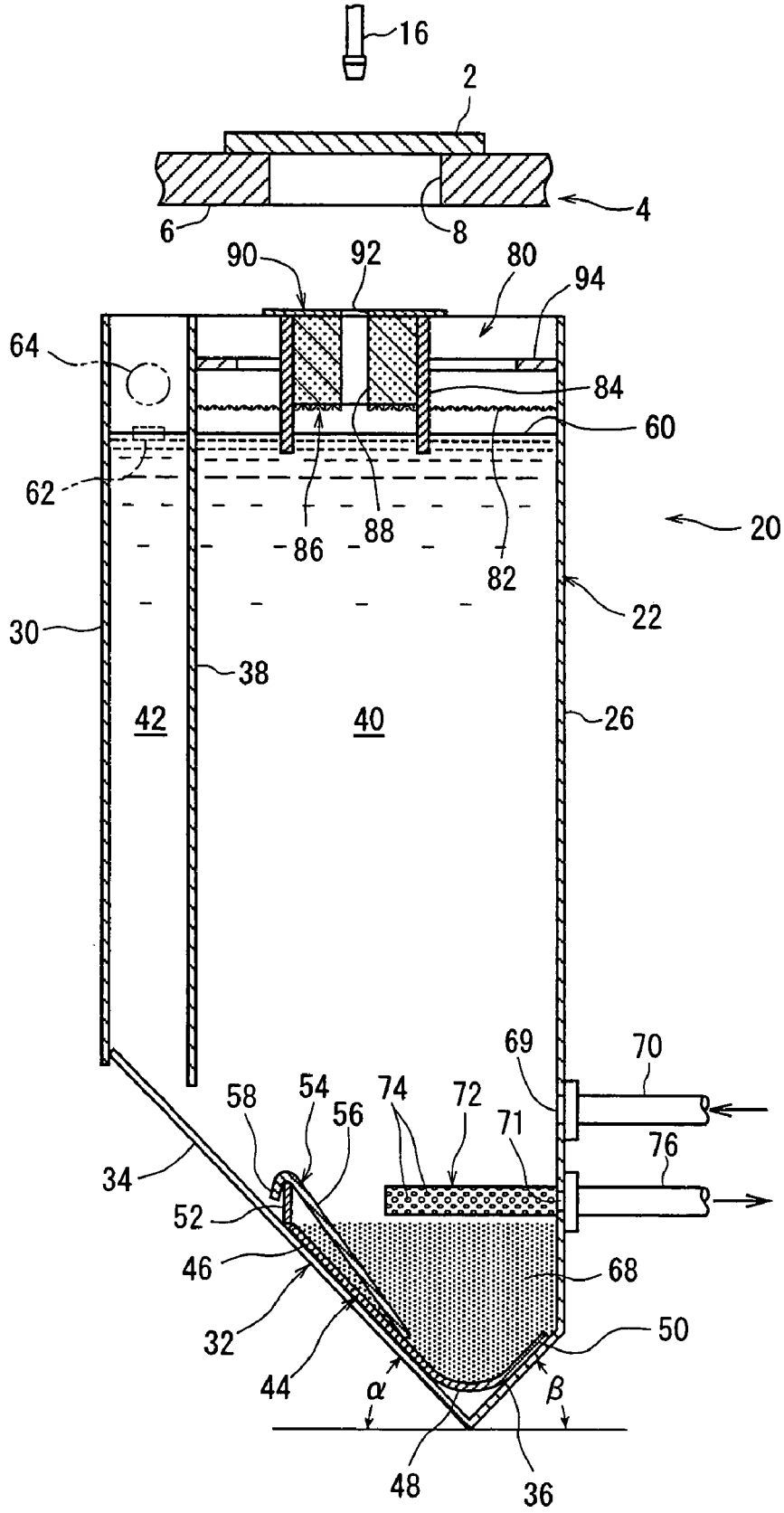
FIG. 3 is a sectional view showing the catching means in the liquid jet machining apparatus of FIG. 1 in a rest state where a liquid jet is not applied to a workpiece.

With reference to FIGS. 2 and 3 along with FIG. 1, the tank 22 of the catching means 20 has four side walls 24, 26, 28 and 30, and a bottom wall 32. The tank 22 can be formed from a suitable metal plate such as a stainless steel plate. The four side walls 24, 26, 28 and 30 of the tank 22 extend substantially vertically. The bottom wall 32 includes a first inclined portion 34 inclined downwardly toward one side in a width direction (namely, rightward in FIG. 3), and a second inclined portion 36 inclined upwardly toward the one side in the width direction (namely, rightward in FIG. 3) in succession to the first inclined portion 34. The borderline between the first inclined portion 34 and the second inclined portion 36 is not located at the center in the width direction of the tank 22, but is displaced toward the one side in the width direction (rightward in FIG. 3). The length in the inclination direction of the first inclined portion 34 is larger than the length in the inclination direction of the second inclined portion 36, and the upper edge of the first inclined portion 34 is located at a higher position than the upper edge of the second inclined portion 36. The inclination angle $\alpha$ of the first inclined portion 34 and the inclination angle $\beta$ of the second inclined portion 36 are each preferably 40 to 50 degrees. A partition wall 38, which extends parallel to the side wall 30 and the side wall 26 between the side wall 24 and the side wall 28, is further disposed in the tank 22. This partition wall 38 can also be formed from a suitable metal plate such as a stainless steel plate. The upper edge of the partition wall 38 is at the same height as that of the upper edge of the tank 22 (namely, the upper edges of the four side walls 24, 26, 28 and 30). On the other hand, the lower edge of the partition wall 38 is located somewhat above the upper surface of the first inclined portion 34 of the bottom wall 32, with the result tat the interior of the tank 22 is divided into two portions, i.e., a main portion 40 and an additional portion 42, which communicate with each other only via their lower parts. The cross-sectional shape of the main portion 40 is substantially a square, while the cross-sectional shape of the additional portion 42 is a rectangle extending slenderly in a direction perpendicular to the sheet face in FIG. 3.

A reinforcing member 44, which covers a lower half of the first inclined portion 34 and the whole of the second inclined portion 36 in the bottom wall 32, is disposed on the bottom surface of the tank 22. The reinforcing member 44 is formed from a suitable metal plate such as a stainless steel plate, and is joined onto the bottom wall 32 by a suitable mode of joining, such as welding or adhesion. As clearly shown in FIG. 3, the reinforcing member 44 has a first flat plate portion 46 extending along the lower half of the first inclined portion 34 of the bottom wall 32, an arcuate portion 48 located above a boundary region between the first inclined portion 34 and the second inclined portion 36, and a second flat plate portion 50 extending along the second inclined portion 36. An engaging piece 52 protruding upwardly from the upper edge of the first flat plate portion 46 is formed in the reinforcing member 44. A cushioning member 54, which can be formed form a suitable metal plate such as a stainless steel plate, is replaceably combined with the reinforcing member 44. In further detail, the cushioning member 54 has a flat plate-shaped main portion 56, and an engaged piece 58 protruding downward from the upper edge of the main portion 56. By the engagement of the engaged piece 58 with the engaging piece 52 of the reinforcing member 44, the cushioning member 54 is suspended at a position illustrated in FIG. 3.

With reference to FIGS. 2 and 3, a liquid 60, which may be tap water or pure water, is accommodated in the tank 22. A liquid upper surface detecting means 62, which, at an upper end portion of the additional portion 42, detects the upper surface of the liquid accommodated within the tank 22, is disposed at an upper end portion of the side wall 24 of the tank 22. As will be further mentioned later, the liquid 60 within the tank 22 keeps a height such that its upper surface is detected by the detecting means 62. In an upper end portion of the side wall 24, an overflow opening 64 located somewhat above the detecting means 62 is formed, and a discharge pipe 66 is annexed to the overflow opening 64. If the upper surface of the liquid 60 accommodated in the tank 22 accidentally rises and reaches the overflow opening 64, the liquid 60 is discharged from the tank 22 through the overflow opening 64 and the discharge pipe 66.

In the liquid jet machining apparatus constructed in accordance with the present invention, it is important that an abrasive 68 is accumulated at the bottom of the tank 22. The upper surface of the accumulated abrasive 68 is preferably located above the upper surface of the middle of the cushioning member 54 (as will be further mentioned later, the liquid jet 18 advancing into the tank 22 is impinged on the upper surface of the middle of the cushioning member 54), in a rest state where the liquid jet 18 is not released from the nozzle means 16, in other words, where the liquid jet 18 is not applied to the workpiece 2, namely, in the state illustrated in FIGS. 2 and 3. In the illustrated embodiment, the abrasive 68 is accumulated nearly up to the upper edge of the first flat plate portion 46 of the reinforcing member 44, in the rest state where the liquid jet 18 is not applied to the workpiece 2. The abrasive 68 is preferably the same as the abrasive incorporated into the liquid in the abrasive incorporating means 14.

A liquid supply opening 69 is formed in a lower portion of the side wall 26 of the tank 22, and a liquid supply pipe 70 is connected to the liquid supply opening. The liquid supply pipe 70 is connected to a liquid supply source (not shown), and a liquid which may be tap water or pure water is supplied into the tank 22 via the liquid supply pipe 70 and the liquid supply opening 69. An abrasive recovery opening 71 located below the liquid supply opening 69 is also formed in the lower portion of the side wall 26. An abrasive suction pipe 72 extending substantially horizontally from the abrasive recovery opening 71 into the tank 22 is disposed within the tank 22. Many suction holes 72 are formed in the circumferential wall of the abrasive suction pipe 72. A free end face of the abrasive suction pipe 72 is closed. The abrasive suction pipe 72 is preferably located somewhat above the upper surface of the abrasive 68 accumulated in the tank 22, in the rest state where the liquid jet 18 is not applied to the workpiece 2, namely, in the state illustrated in FIGS. 2 and 3. An abrasive recovery pipe 76 is connected to the abrasive recovery opening 71. The abrasive recovery pipe 76 extends up to an abrasive screening means 78 (FIG. 1). As will be further mentioned later, the liquid 60 and the abrasive 68 are sucked from within the tank 22 into the abrasive suction pipe 72 through the suction holes 74, and transported to the abrasive screening means 78 through the abrasive recovery opening 71 and the abrasive recovery pipe 76. In the abrasive screening means 78, the abrasive of an appropriate particle size is selected, for example, by passage through a suitable filter. The selected abrasive 68 is supplied to the aforementioned abrasive incorporating means 14 (FIG. 1), where the abrasive is incorporated into the high pressure liquid. The abrasive 68 which has not been selected is discharged together with the incidental liquid.

With reference to FIGS. 2 and 3, a wave suppressing means, entirely indicated at the reference numeral 80, is disposed in an upper end portion of the main portion 40 of the tank 22. The wave suppressing means 80 in the illustrated embodiment has a square net member 82 having four side edges fixed to the inner surfaces of the side walls 24, 26 and 28 of the tank 22 and the partition wall 38. The net member 82 formed from a suitable metal net is disposed somewhat above the upper surface of the liquid 60 accommodated within the tank 22, in the rest state where the liquid jet 18 is not applied to the workpiece 2. A tubular wave restricting member 84, which penetrates the net member 82 and extends substantially vertically, is mounted on the net member 82. The illustrated tubular wave restricting member 84 is of a regular tetragonal tubular shape having a square cross-sectional shape. The tubular wave restricting member 84 can be formed from a suitable metal plate such as a stainless steel plate. The tubular wave restricting member 84 preferably extends continuously from above the upper surface of the liquid 60 accommodated in the tank 22 into the liquid 60, in the rest state where the liquid jet 18 is not applied to the workpiece 2. In the illustrated embodiment, the upper end of the tubular wave restricting member 84 is at substantially the same height as the height of the upper end of the tank 22, and the lower end of the tubular wave restricting member 84 is located somewhat below the upper surface of the liquid 60 accommodated in the tank 22. As will be further mentioned later, the liquid jet 18 which has penetrated the workpiece 2 acts on the upper surface of the liquid 60 at the central position of a region surrounded by the tubular wave restricting member 84. In other words, the tubular wave restricting member 84 surrounds that site of the upper surface of the liquid 60 within the tank 22 which is acted on by the liquid jet 18. A rectangular parallelepiped space defined by the net member 82 and the tubular wave restricting member 84 is filled with a rectangular parallelopipedal elastic wave cushioning member 86. The wave cushioning member 86 can be formed from a suitable elastic member, for example, synthetic rubber, foamed synthetic resin, or sponge. A through-hole 88 extending in a vertical direction is formed in the center of the wave cushioning member 86. A lid member 90 is openably and closably connected to the upper edge of the side wall 28 of the tank 22 via a hinge. When the lid member 90 is brought to a closing position shown in FIG. 3, the upper surface of the tubular wave restricting member 84 is closed with the lid member 90, and the upward movement of the wave cushioning member 86 is inhibited. If desired, the wave cushioning member 86 can be arranged such that, when in a free state, it somewhat protrudes beyond the upper end of the tubular wave restricting member 84, but when the lid member 90 is brought to the closing position, is somewhat compressed, and brought into the state illustrated in FIG. 3. A through-hole 92 is formed at the center of the lid member 90 and, when the lid member 90 is brought to the closing position, the through-hole 92 aligns with the through-hole 88 of the wave cushioning member 86. A suitable locking mechanism for locking the lid member 90 in the closing position is annexed to the lid member 90, although this is not shown. In the illustrated embodiment, the tubular wave restricting member 84 is in a regular tetragonal tubular shape, but if desired, a tubular wave restricting member of a cylindrical shape, an elliptical tubular shape, or a polygonal tubular shape, other than a regular tetragonal tubular shape, can be used.

The wave suppressing means 80 in the illustrated embodiment further includes an annular wave restricting member 94 protruding from the inner surfaces of the side walls 24, 26 and 28 of the tank 22 and the partition wall 38. The annular wave restricting member 94 can be formed from a suitable metal plate such as a stainless steel plate. The annular wave restricting member 94, which can be joined to the inner surfaces of the side walls 24, 26 and 28 and the partition wall 38 by a suitable mode of joining, such as welding or adhesion, protrudes substantially horizontally from the inner surfaces of the side walls 24, 26 and 28 and the partition wall 38, and surrounds the aforementioned tubular wave restricting member 84 at a spacing from the outer peripheral surface of the tubular wave restricting member 84. Importantly, the annular wave restricting member 94 is located above the upper surface of the liquid 60 accommodated within the tank 22, in the rest state where the liquid jet 18 is not applied to the workpiece 2. In the illustrated embodiment, the annular wave restricting member 94 is located somewhat above the lower surface of the wave cushioning member 86.

Figure 4:
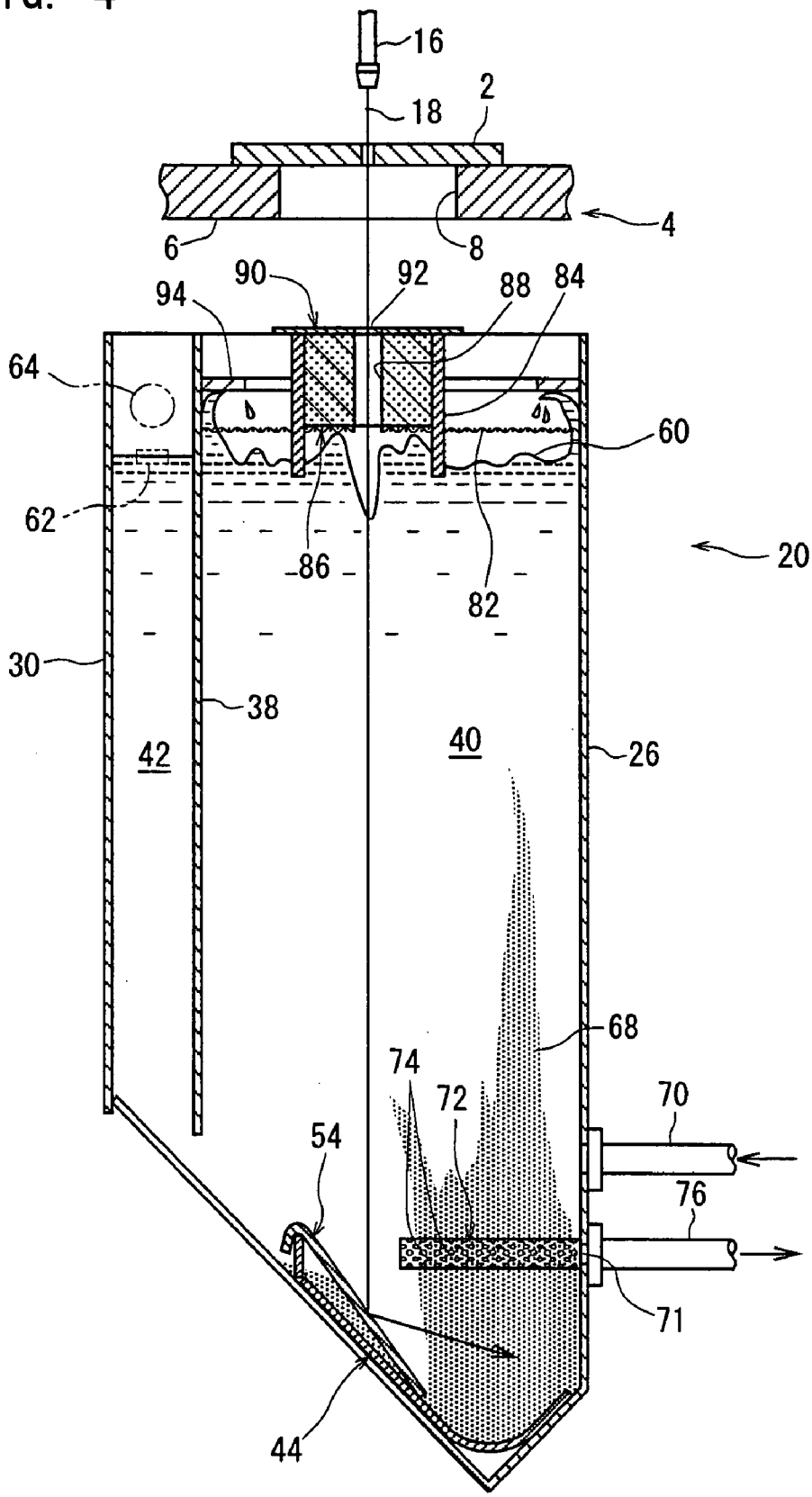
FIG. 4 is a sectional view showing the catching means in the liquid jet machining apparatus of FIG. 1 in an operating state where the liquid jet is applied to the workpiece.

With reference to FIGS. 3 and 4, the actions of the aforementioned catching means 20 will be described. As shown in FIG. 4, when the liquid jet 18 is released from the nozzle means 16, the liquid jet 18 penetrates the workpiece 2, passes through the opening 8 of the holding plate 6, and advances substantially vertically downwardly. Then, the liquid jet 18 advances through the through-hole 92 of the lid member 90, the through-hole 88 of the wave cushioning member 86, and the net meshes of the net member 82, and moves into the liquid 60 accommodated within the tank 22. The impingement of the liquid jet 18 upon the upper surface of the liquid 60 causes a considerable shock to the upper surface of the liquid 60. However, the generation of waves due to such a shock is restricted or suppressed by the tubular wave restricting member 84 which surrounds the site of the upper surface of the liquid 60 which the liquid jet 18 impinges on. Generated waves are cushioned by acting on the wave cushioning member 86. Furthermore, waves which have spread to regions outside of the tubular wave restricting member 84 are suppressed or restricted by the annular wave restricting member 94. Thus, the generation of excessively large waves is effectively suppressed, and the splashing of the liquid 60 out of the tank 22 is effectively prevented. The additional portion 42 of the tank 22 is spaced from the main portion 40 by the partition wall 38. Thus, untoward waves are not generated on the upper surface of the liquid 60 in the additional portion 42, and the liquid upper surface detecting means 62 can appropriately detect the upper surface of the liquid 60 without being impeded by the waves.

The liquid jet 18, which has advanced into the liquid 60, has its kinetic energy decreased by advancing downwardly within the liquid 60. Then, the liquid jet 18 acts on the abrasive 68, if the abrasive 68 is accumulated on the cushioning member 54, whereafter the liquid jet 18 impinges on the middle portion of the upper surface of the cushioning member 54. Then, the liquid jet 18 is reflected by the upper surface of the cushioning member 54, and is then brought into a collision with the accumulated abrasive 68. Upon impingement on the cushioning member 54 and collision with the accumulated abrasive 68, the liquid jet 18 has its kinetic energy sufficiently decreased. Even if the liquid jet 18 after reflection by the upper surface of the cushioning member 54 and collision with the abrasive 68 acts on the side walls 24, 26 and 28 of the tank 22 and the reinforcing member 44, there is substantially no damage to the side walls 24, 26 and 28 and the reinforcing member 44. If the cushioning member 54 is excessively damaged by the action exerted by the liquid jet 18, the cushioning member 54 can be replaced by a new one. For the convenience of replacement of the cushioning member 54, it is advantageous to define a suitable site of the side wall 24 or 28 (FIG. 2) of the tank 22 by a door member (not shown) which is free to open and close.

When the liquid jet 18 reflected by the upper surface of the cushioning member 54 acts on the accumulated abrasive 68, the abrasive 68 is scattered upward, as shown in FIG. 4, by the kinetic energy conveyed from the liquid jet 18 to the abrasive 68. Thus, when the liquid 60 is sucked through the abrasive recovery pipe 76, the abrasive 68 accompanying the liquid 60 is also sucked into the abrasive suction pipe 72 through the suction holes 74, and flowed into the abrasive recovery pipe 76 through the abrasive recovery opening 71. Preferably, the amount of recovery of the abrasive 68 through the abrasive recovery pipe 76 is made to correspond with the amount of the abrasive 68 carried into the tank 22 as an accompaniment to the liquid jet 18 advanced into the tank 22. Thus, the amount of the abrasive 68 present within the tank 22 is preferably maintained nearly constant. Desirably, the amount of the liquid 60 present in the tank 22 is also kept substantially constant. The liquid 60 in the tank 22 is increased by the advancement of the liquid jet 18 into the tank 22, and is decreased by the discharge of the liquid 60 from the tank 22 through the abrasive recovery pipe 76. If the upper surface of the liquid 60 in the additional portion 42 of the tank 22 becomes lower than the height detected by the liquid upper surface detecting means 62, the liquid 60 can be supplied into the tank 22 through the liquid supply pipe 70. If the liquid 60 within the tank 22 accidentally becomes excessive in amount, and the upper surface of the liquid 60 in the additional portion 42 rises excessively, the liquid is discharged from the tank 22 through the overflow opening 64 and the discharge pipe 66 (FIG. 2) connected thereto.

While the preferred embodiments of the liquid jet machining apparatus constructed according to the present invention have been described in detail by reference to the accompanying drawings, it is to be understood that the invention is not limited to such embodiments, but various changes and modifications may be made without departing from the scope of the invention.

What we claim is:

1. A liquid jet machining apparatus including holding means for holding a workpiece, liquid jet application means for applying a liquid jet to the workpiece held by said holding means, and catching means for catching the liquid jet which has penetrated the workpiece, said catching means including a tank for accommodating a liquid, and wherein at a bottom of said tank, a cushioning member is replaceably disposed, and an abrasive is accumulated, and after the liquid jet having penetrated the workpiece acts on the liquid accommodated in said tank, the liquid jet acts on said cushioning member and said abrasive, and wherein the liquid jet advances into said tank substantially vertically downwardly, said tank is erected, a bottom wall of said tank has a first inclined portion inclined downwardly toward one side in a width direction, and a second inclined portion inclined upwardly toward the one side in the width direction in succession to said first inclined portion, and said cushioning member extends along said first inclined portion, and wherein a length in an inclination direction of said first inclined portion is larger than a length in an inclination direction of said second inclined portion, a site of said cushioning member acted on by the liquid jet is located at a higher position than an upper end of said second inclined portion, and in a rest state where the liquid jet is not applied to the workpiece, an upper surface of the abrasive accumulated in said tank is above said site of said cushioning member.

2. A liquid jet machining apparatus including holding means for holding a workpiece, liquid jet application means for applying a liquid jet to the workpiece held by said holding means, and catching means for catching the liquid jet which has penetrated the workpiece, said catching means including a tank for accommodating a liquid, and wherein at a bottom of said tank, a cushioning member is replaceably disposed, and an abrasive is accumulated, and after the liquid jet having penetrated the workpiece acts on the liquid accommodated in said tank, the liquid jet acts on said cushioning member and said abrasive and, wherein wave suppressing means for suppressing generation of waves due to the liquid jet acting on the liquid accommodated within said tank is disposed in an upper portion of said tank.

3. The liquid jet machining apparatus according to claim 2, wherein the liquid jet advances into said tank substantially vertically downwardly, said tank is erected, said wave suppressing means includes a tubular wave restricting member for surrounding a site of an upper surface of the liquid accommodated within said tank, said site being acted on by the liquid jet, and an elastic wave cushioning member filled into said tubular wave restricting member, in a rest state where the liquid jet is not applied to the workpiece, said tubular wave restricting member extends continuously from above the upper surface of the liquid accommodated within said tank into the liquid, said wave cushioning member is located above the upper surface of the liquid accommodated within said tank, and a through-hole, through which the liquid jet is passed, is formed in said wave cushioning member.

4. The liquid jet machining apparatus according to claim 3, wherein said wave suppressing means further includes an annular wave restricting member which protrudes horizontally inwardly from an inner surface of a wall of said tank, surrounds said tubular wave restricting member at a spacing from an outer peripheral surface of said tubular wave restricting member, and in a rest state where the liquid jet is not applied to the workpiece, is located above the upper surface of the liquid accommodated in said tank.

5. The liquid jet machining apparatus according to claim 2, wherein a partition wall is disposed in said tank, an interior of said tank is divided into a main portion and an additional portion which communicate with each other only in a lower portion of said tank, said wave suppressing means is disposed in said main portion, and liquid upper surface detecting means for detecting an upper surface of the liquid accommodated in said tank is disposed in said additional portion.

6. A liquid jet machining apparatus including holding means for holding a workpiece, liquid jet application means for applying a liquid jet to the workpiece held by said holding means, and catching means for catching the liquid jet which has penetrated the workpiece, said catching means including a tank for accommodating a liquid, and wherein wave suppressing means for suppressing generation of waves due to the liquid jet acting on the liquid accommodated within said tank is disposed in an upper portion of said tank.

7. The liquid jet machining apparatus according to claim 6, wherein the liquid jet advances into said tank substantially vertically downwardly, said tank is erected, said wave suppressing means includes a tubular wave restricting member for surrounding a site of an upper surface of the liquid accommodated within said tank, said site being acted on by the liquid jet, and an elastic wave cushioning member filled into said tubular wave restricting member, in a rest state where the liquid jet is not applied to the workpiece, said tubular wave restricting member extends continuously from above the upper surface of the liquid accommodated within said tank into the liquid, said wave cushioning member is located above the upper surface of the liquid accommodated within said tank, and a through-hole, through which the liquid jet is passed, is formed in said wave cushioning member.

8. The liquid jet machining apparatus according to claim 7, wherein said wave suppressing means further includes an annular wave restricting member which protrudes horizontally inwardly from an inner surface of a wall of said tank, surrounds said tubular wave restricting member at a spacing from an outer peripheral surface of said tubular wave restricting member, and in a rest state where the liquid jet is not applied to the workpiece, is located above the upper surface of the liquid accommodated in said tank.

9. The liquid jet machining apparatus according to claim 6, wherein a partition wall is disposed in said tank, an interior of said tank is divided into a main portion and an additional portion which communicate with each other only in a lower portion of said tank, said wave suppressing means is disposed in said main portion, and liquid upper surface detecting means for detecting an upper surface of the liquid accommodated in said tank is disposed in said additional portion.

* * * * *